US005490328A

United States Patent [19]

Ueda et al.

[11] Patent Number: 5,490,328

[45] Date of Patent: Feb. 13, 1996

[54] DRY SHAVER

[75] Inventors: Yasunori Ueda, Hirata; Kiyotaka Otsuka, Sugoshi, both of Japan

[73] Assignee: Matsushita Electric Works, Ltd., Osaka, Japan

[21] Appl. No.: 247,583

[22] Filed: May 23, 1994

[30] Foreign Application Priority Data

May 31, 1993 [JP] Japan ..... 5-129537

[51] Int. Cl.[6] ..... B26B 19/04

[52] U.S. Cl. ..... 30/43.92; 30/43.91

[58] Field of Search ..... 30/43.1, 43.6, 30/43.91, 43.92, 346.51

[56] References Cited

U.S. PATENT DOCUMENTS

| | | | |
|---|---|---|---|
| 4,292,737 | 10/1981 | Packham . | |
| 4,866,843 | 9/1989 | Kumano . | |
| 4,896,421 | 1/1990 | Geertsma et al. | 30/43.6 |
| 5,189,792 | 3/1993 | Otsuka et al. | 30/43.92 |

FOREIGN PATENT DOCUMENTS

| | | |
|---|---|---|
| 2949301 | 6/1980 | Germany . |
| 3743181 | 7/1988 | Germany . |
| 4142070 | 7/1992 | Germany . |
| 4117990 | 12/1992 | Germany . |
| 4132581 | 5/1992 | Japan . |

*Primary Examiner*—Douglas D. Watts

*Attorney, Agent, or Firm*—Stevens, Davis, Miller & Mosher

[57] ABSTRACT

A dry shaver has a housing with a head frame floatingly supporting an outer shearing foil. An associated inner cutter is driven to move in hair shearing engagement with the outer shearing foil. The head frame is formed with a stopper which is in use adapted to come into contact with a user's skin. The shaver is characterized in that the outer shearing foil is supported to the head frame by means of a floating mechanism which, when the outer shearing foil is depressed at a given portion by contact with the user's skin, allows an upper end of the depressed portion of the outer shearing foil to displace down beyond the stopper such that the stopper comes into contact with the skin for bearing the depressing force.

6 Claims, 8 Drawing Sheets

DRY SHAVER

BACKGROUND OF THE INVENTION

1. Field of the Invention

The present invention is directed to a dry shaver, and more particularly to a dry shaver with one or more floating shaving heads.

2. Description of the Prior Art

Dry shavers having a floating shaving head are known in the art, for example, as disclosed in U.S. Pat. No. 5,189,792. In the prior art shaver, a head frame is provided on a shaver housing to mount two shaving heads of elongated configuration. The shaving head is floatingly supported at opposed longitudinal ends thereof to associated end walls of the head frame by means of spring members so that the shaving head can be depressed evenly at the longitudinal ends or differently at either of the longitudinal ends nearly independently from one another. However, the shaving head is only permitted to be depressed to such a limited extent that the longitudinal ends are kept above the upper end of the head frame when the shaving head is depressed to a maximum extent. For this reason, when the shaving head is strongly against the user's skin, only the shaving head is responsible for bearing the pressing force. As the shaving head is mainly composed of an outer shearing foil which is made as thin as possible to assure close shaving, the outer shearing foil may be permanently deformed or even damaged when excessive pressing force is applied substantially solely to the outer shearing force.

SUMMARY OF THE INVENTION

The above problem has been eliminated in a dry shaver of the present invention. The shaver in accordance with the present invention comprises a housing mounting a head frame which supports an outer shearing foil in a floating manner. Disposed inside of the head frame is an inner cutter which is driven by a drive element to move in hair shearing engagement with the outer shearing foil. The head frame is formed with a stopper which is adapted in use to come into contact with a user's skin. The outer shearing foil is supported to the head frame by means of a floating mechanism which, when the outer shearing foil is depressed at a given portion by contact with the user's skin, allows an upper end of the depressed portion of the outer shearing foil to displace down beyond the stopper such that the stopper comes into contact with the skin for bearing the depressing force. With this floating support, when the outer shearing foil is pressed strongly against the user's skin attendant with a corresponding depression thereof, the stopper acts to bear the pressing force in cooperation with or instead of the outer shearing foil, thereby protecting the outer shearing foil from suffering alone from an excessive pressing force.

Accordingly, it is a primary object of the present invention to provide a dry shaver with the floating outer shearing foil which is protected from being unduly deformed or damaged even when the outer shearing foil is pressed strongly against the user's skin.

In a preferred embodiment, the head frame includes more than one shaving head composed of the outer shearing foil, the inner cutter and the drive element. The shaving heads are arranged in spaced relation within the head frame and in such a manner as to have the individual upper portions projecting upwardly of the head frame when no external depressive force is applied. The head frame is formed with a rib which extends between the outer shearing foils of the adjacent shaving heads to define itself as the stopper. The stopper may be defined by the upper end of the head frame around the opening and/or by the rib.

Further, the head frame carries a trimmer composed of a pair of toothed blades one of which is driven to reciprocate in hair cutting engagement with the other blade in a horizontal direction generally perpendicular to the direction along which the outer shearing foil is movable relative to the head frame. The toothed blades are held on a trimmer holder of which a portion projects upwardly of the head frame to define the above described stopper at this portion. The trimmer is preferably floatingly supported to the head frame to be displaceable independently of the outer shearing foil.

The above and other advantageous features of the present invention will become more apparent from the following description of the preferred embodiment and modifications when taken in conjunction with the attached drawings.

DETAILED DESCRIPTION OF THE EMBODIMENT

Figure 1:
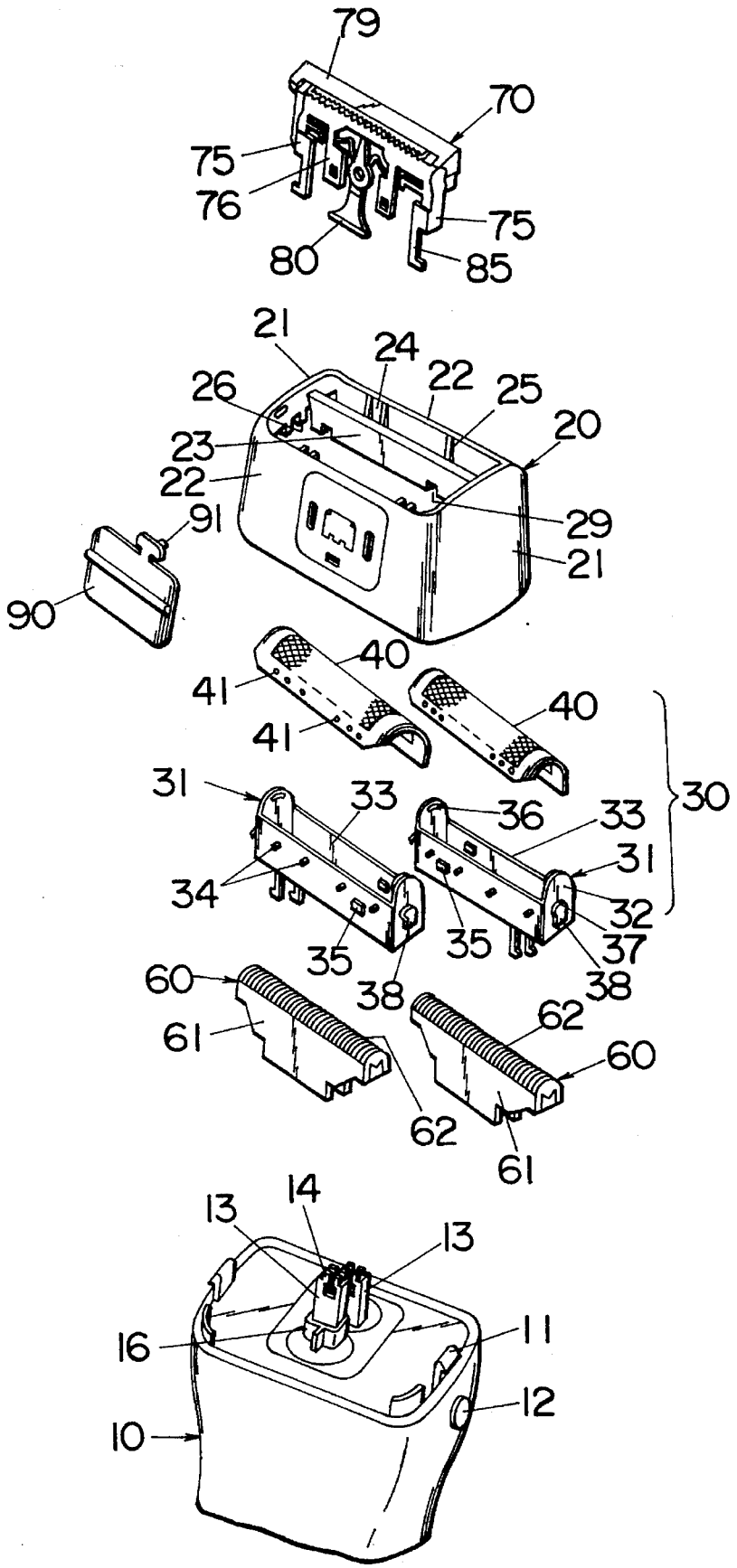
FIG. 1 is an exploded perspective view of a dry shaver in accordance with a preferred embodiment of the present invention.
Figure 2:
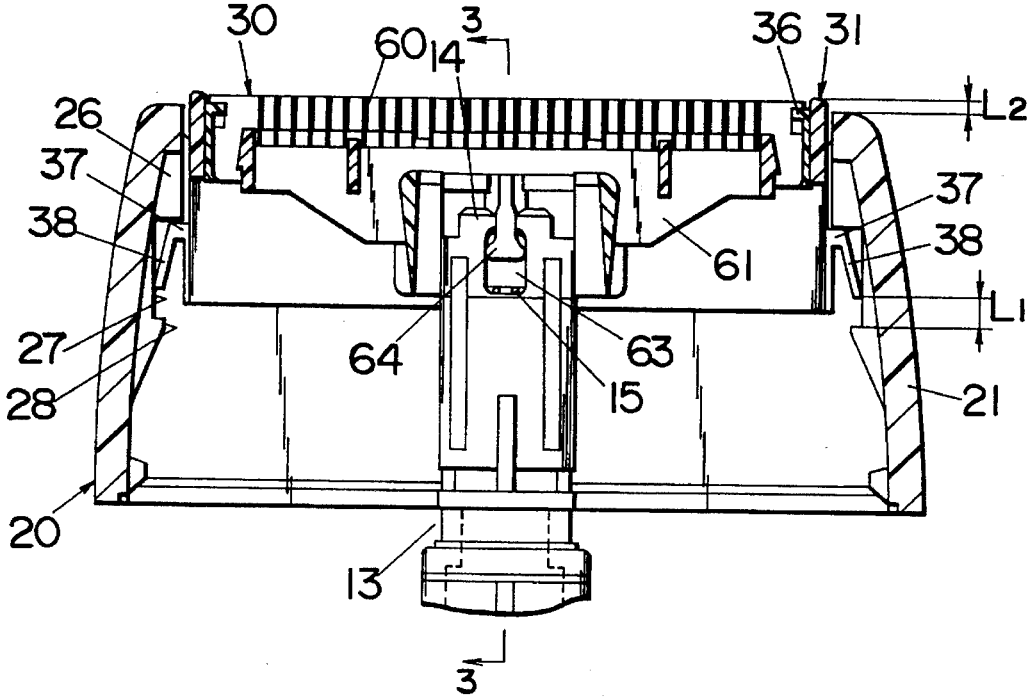
FIG. 2 is a front section of a shaving head of the shaver.
Figure 3:
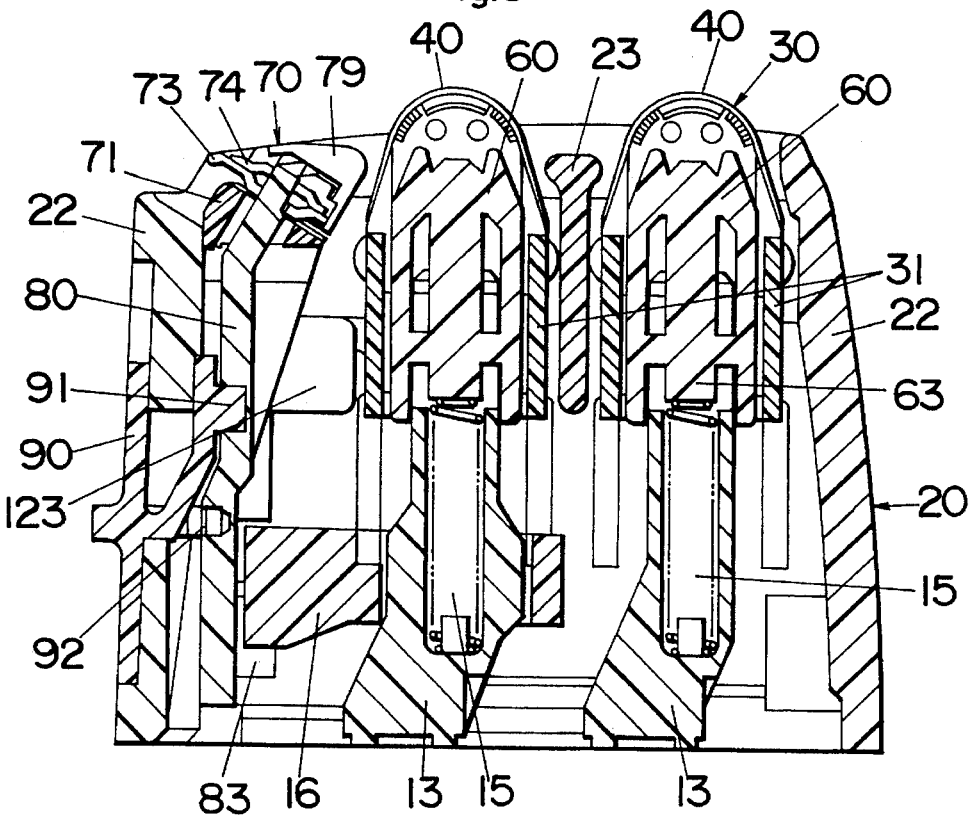
FIG. 3 is a side section of the shaving head, as taken along a line 3—3 of FIG. 2.

Referring now to FIGS. 1 to 4, there is shown a reciprocatory electric shaver in accordance with a preferred embodiment of the present invention. The shaver comprises a shaver housing 10 mounting thereon a head frame 20 which carries a parallel pair of elongated shaving heads 30. The head frame 20 is detachably mounted to the housing 10 by means of hooks 11 projecting on the upper end of the housing 10 and can be detached therefrom by pressing a release button 12 on the housing 10. Each shaving head 30 comprises an outer shearing foil 40 bent into a generally inverted U-shape configuration to have an apex which extends longitudinally of the shaving head 30 to define a longitudinal axis of the shaving head 30. A pair of inner cutters 60 project on the top of the housing 10 into hair shearing engagement respectively with the outer shearing foils 40 of the shaving heads 30. Each inner cutter 60 has a base 61 mounting a plurality of arcuately contoured blades 62 and is coupled to each one of drive elements 13 projecting on top of the housing 10. The drive elements 13 are connected to an electric motor (not shown) in the housing 10 by way of a rotary-to-reciprocation conversion mechanism (not shown) so as to reciprocate in opposite direction to each other for reciprocation of the individual inner cutters 60 relative to the outer shearing foil 40. As shown in FIG. 2, each inner cutter 60 is coupled to the drive element 13 by engagement of hooks 14 at the upper end of the element 13 with bosses 64 on the sides of a stem 63 depending from the base 61 of the inner cutter 60. This engagement the inner cutter 60 allows to move vertically relative to the drive element 13 and therefore the head frame 20. As best shown in FIG. 3, a coil spring 15 is held between an inner bottom of the drive element 13 and the lower end of the stem 63 in order to urge the inner cutter 60 upwardly together with the associated outer shearing foil 40, while keeping intimate contact therebetween.

Figure 4:
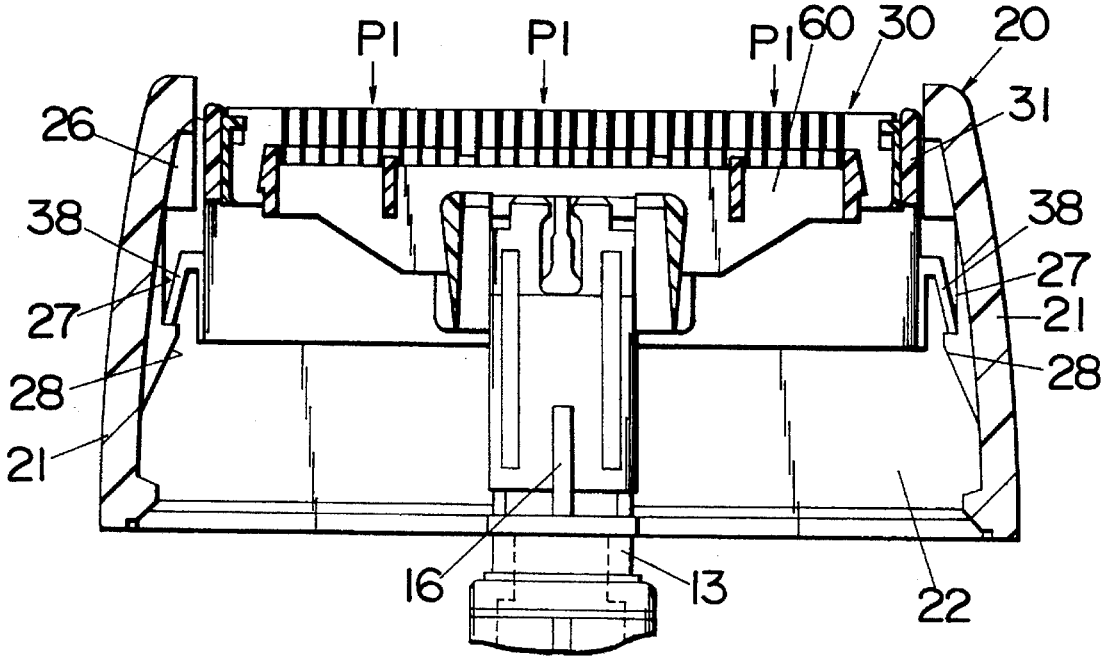
FIGS. 4 and 5 are front sections illustrating the shaving heads in different depressed conditions.
Figure 5:
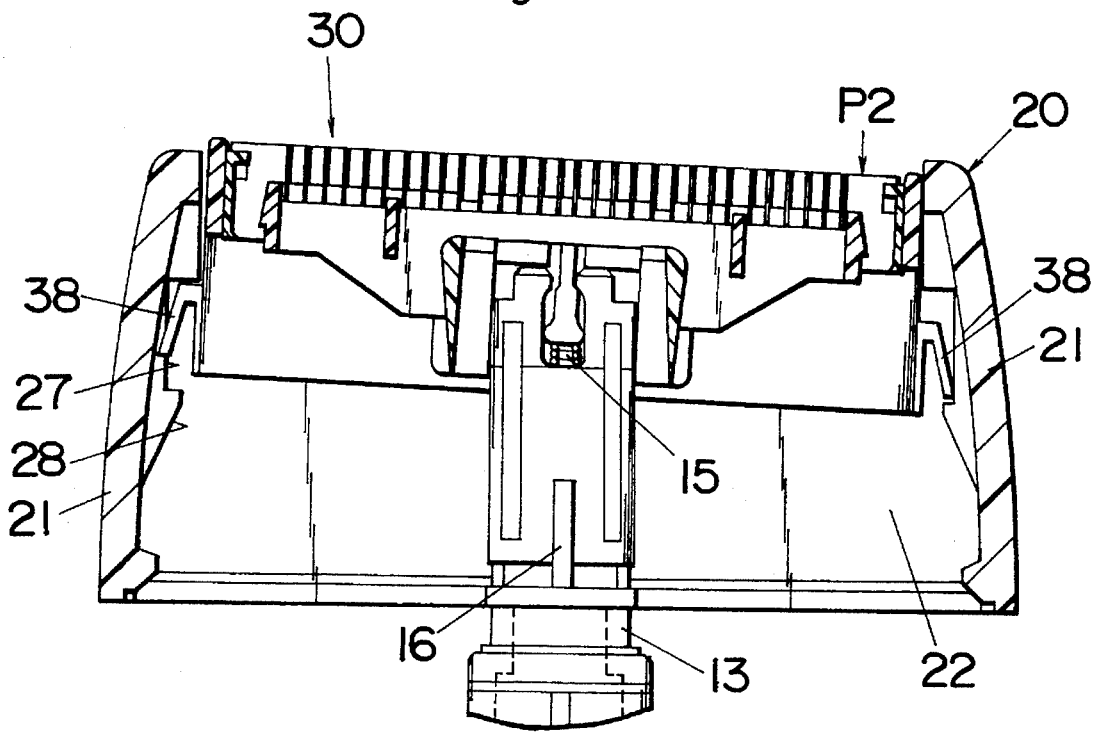

The head frame 20 is made from a plastic material into a generally rectangular configuration having opposed end walls 21, opposed side walls 22 and a separator rib 23 dividing the interior of the frame 20 laterally into two openings receiving each one of the shaving heads 30. The side wall 22 is formed with a longitudinally spaced pair of a vertical grooves 24 and a ridge 25 for slidably guiding the shaving head 30. Formed on the interior surface of each end wall 21 is a pair of retainer projections 26 for retaining the shaving heads to the head frame 20. As shown in FIG. 2, each end wall 21 is also formed with a pair of rails 27 each projecting immediately below the retainer projections 26 and having a shoulder 28 at the lower end thereof. The separator rib 23 is formed with notches 29 analogous with the groove 24 in the side wall 22. Each shaving head 30 comprises a rectangular cassette 31 molded from a plastic material to have opposed end plates 32 connected by side bars 33. The outer shearing foil 40 is curved arcuately between the opposed side bars 33 and secured thereto by engagement of posts 34 on the side bars 33 into corresponding apertures 41 in the lateral sides of the shearing foils 40. The side bar 33 is formed with protrusions 35 which are slidably fitted into the corresponding grooves 24 in the head frame 20 and the notches 29 in the rib 23 so that the shaving heads 30 are slidably supported to the head frame 20. Each end plate 32 is formed on its inner surface with arcuately contoured guide 36 along which the longitudinal end of the shearing foil 40 is curved. Also, each end plate 32 is formed on its exterior surface with an integral bump 37 from which a resilient leg 38 depends downwardly and outwardly, as best shown in FIG. 2. The bump 37 is configured to have an arcuately rounded top end for point contact with the lower end of the retainer projection 26 on the interior of the head frame 20 such that each cassette 31 or the shaving head 30 can pivot about the longitudinal axis within a limited angular range for assuring an intimate contact of the outer shearing foil 40 with the user's skin. The resilient leg 38 has its end kept abutted against the rail 27 below the retainer projection 26. In a normal condition of FIG. 2 where no pressing force is applied to the shaving head 30, the shaving head 30 is urged upwardly by the spring 15 until the bump 37 abuts against the projection 26 to be kept at this position. At this position, the lower end of the resilient leg 38 is spaced upwardly from the shoulder 28 of the rail 27 by a distance L1, and the upper end of the shaving head 30 projects above the upper end of the head frame 20 by a distance of L2 which is shorter than L1 (L1> L2). When the shaving head 30 is depressed by contact with the user's skin, the longitudinal ends of the shaving head 30 are respectively permitted to displace downward in a manner attendant either with parallel downward movement or inclination of the shaving head 30, as shown in FIGS. 4 and 5, until the leg 38 is stopped by the shoulder 28. In this sense, the shaving heads 30 are floatingly supported to the head frame 20 and are allowed to be depressed until the legs 38 are stopped against the shoulders 28 after travelling the distance L1. From the relation L1>L2, the shaving head 30 is permitted to have its upper end depressed down beyond the upper end of the head frame 20. That is, a depressed portion of the shaving head 30 or the outer shearing foil 40 is permitted to go down beyond the upper end of the head frame 20, as shown in FIG. 4 where the outer shearing foil 40 receives a depressing force P1 evenly over the length thereof or in FIG. 5 where the outer shearing foil receives a local depressing force P2 at one longitudinal end thereof. When the shaving head 30 is so depressed beyond the upper end of the head frame 20, an adjacent portion of the upper end of the head frame 20 comes into contact with the skin and therefore acts as a stopper which bears the depressive force in cooperation with the shaving head 30. Thus the the outer shearing foil 40 can be protected from experiencing excessive force and therefore protected from excessive deformation and possible damage. In this embodiment, the end walls 21 and one of the side walls 22 of the head frame 20 have their upper ends lying on a general top plane of the head frame 20 which defines an upper extremity of the shaver except for the floating shaving heads 30, as shown in FIG. 3, separator rib 23 has its top disposed below the top plane. Therefore, the above stopper is defined as the upper ends of the end walls 21 and one of the side walls 22 of the head frame 20, while the shaving heads 30 are depressed at portion adjacent these upper ends. Adjacent to the other side wall 22 having its upper end lowered relative to the end walls 21 there is mounted a trimmer 70 which has a portion projecting to the top plane of the head frame 20 to define another stopper for bearing the depressive force, as will be discussed hereinafter.

Figure 6:
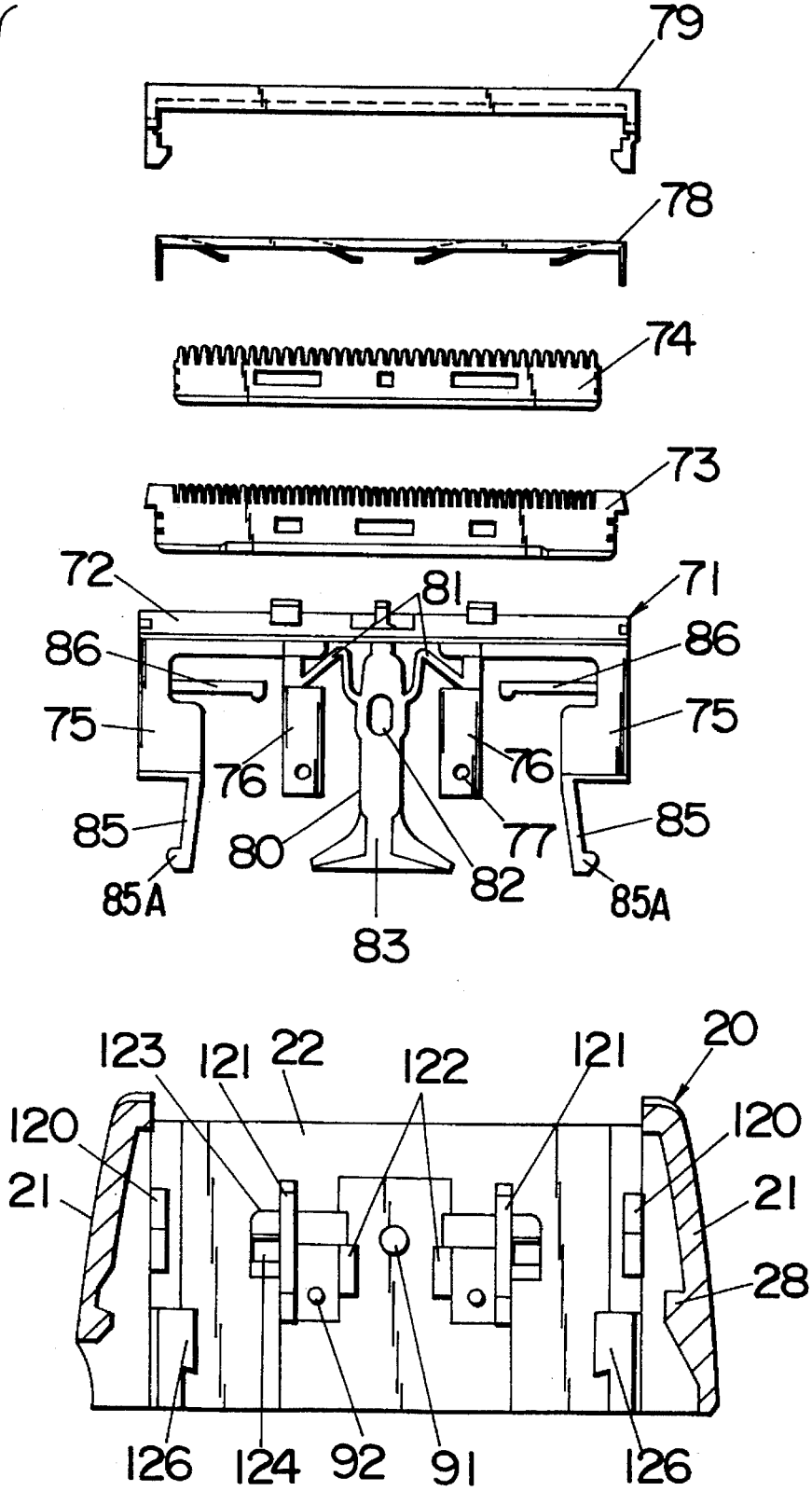
FIG. 6 is an exploded view, partly in section, of a trimmer and a head frame of the shaver.
Figure 9:
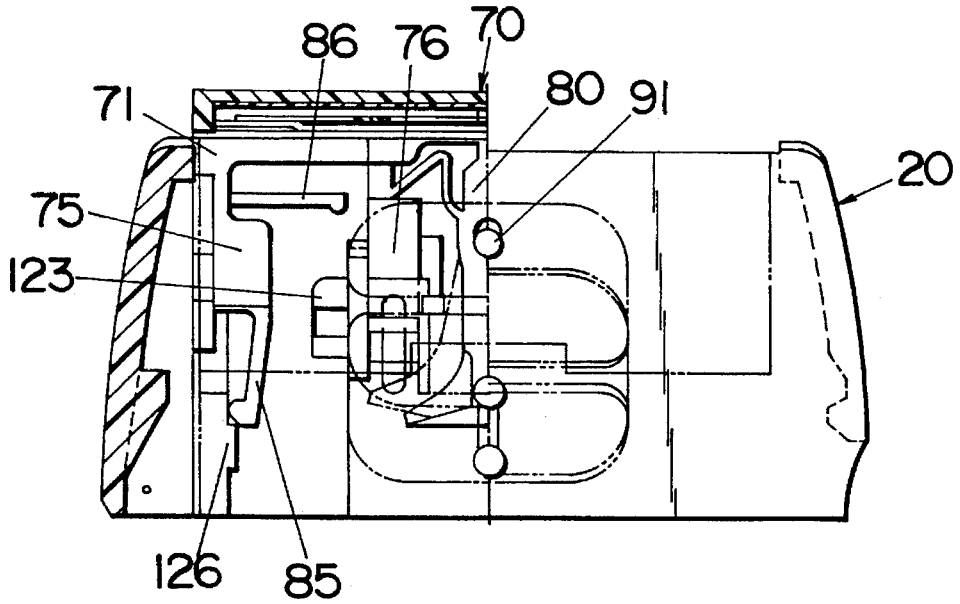
FIG. 9 is a front section illustrating the trimmer in its projected position.

The trimmer 70 is mounted interior of the short side wall 22 and is coupled a slider handle 90 on the exterior of the head frame 20 to be vertically slidable between a normal position of FIG. 3 in which the trimmer is utilized in cooperation with the shaving heads 30 and a projected position of FIG. 9 in which the trimmer is utilized independently of the shaving heads 30. As shown in FIG. 6, the trimmer 70 comprises a plastic holder 71 with a top platform 72 mounting thereon a toothed stationary blade 73 and a toothed movable blade 74. The holder 71 has a pair of outer tabs 75 and a pair of inner tabs 76 depending from the platform 72 for slidable connection to the head frame 20 with each outer tab 75 inserted between a guide rib 120 projecting in the interior of the head frame 20 and the short side wall 22 thereof and with each inner tab 76 inserted between a pair of guide ribs 121 and 122 projecting on the interior of the short-side wall 22. Formed adjacent to the guide rib 121 is a stud 123 with a guide hole 124 which receives the protrusion 35 on the one adjacent shaving head 30 in the same manner as the protrusion 35 of the other shaving head 30 is received in the groove 24 in the tall side wall 22 of the head frame 20. A pivot lever 80 extends vertically and joins integrally to the holder 71 by means of thin resilient joints 81 which allow the lever 80 to move relative to the holder 71 to a limited extent. The lever 80 is formed with a vertically elongated hole 82 into which a pin 91 on the slider handle 90 is engaged so that the lever 80 pivots about the pin 91. The holder 71 is also coupled to the handle 90 by tight engagement of pins 92 on the handle into corresponding holes 77 in the inner tab 76. The lower end of the lever 80 is connected to one of the drive elements 13 so that the lever is driven to give a reciprocation movement to the movable blade 74 connected to the upper end of the lever 80. To this end, the drive element 13 has an extension 16 which is slidably fitted in a slot 83 formed in the lower end of the lever 80. The movable blade 74 is held pressed against the stationary blade 73 by a spring fitting 78 to give a suitable contacting pressure therebetween. The spring fitting 78 is secured over the movable blade 74 to the platform 72. A top cover 79 is also fitted on the platform 72 to cover the upper end of the trimmer 70 in such a manner as to expose only the toothed edges of the blades 73 and 74, as shown in FIG. 3.

Figure 7A:
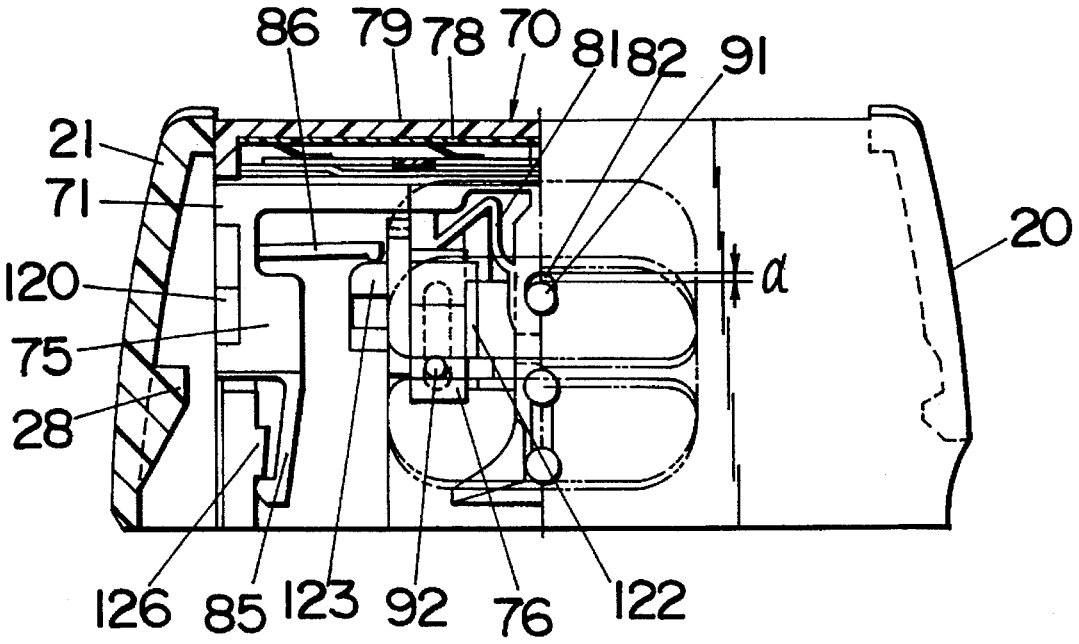
FIGS. 7A and 7B are front sections illustrating the trimmer in normal and depressed positions, respectively.
Figure 7B:
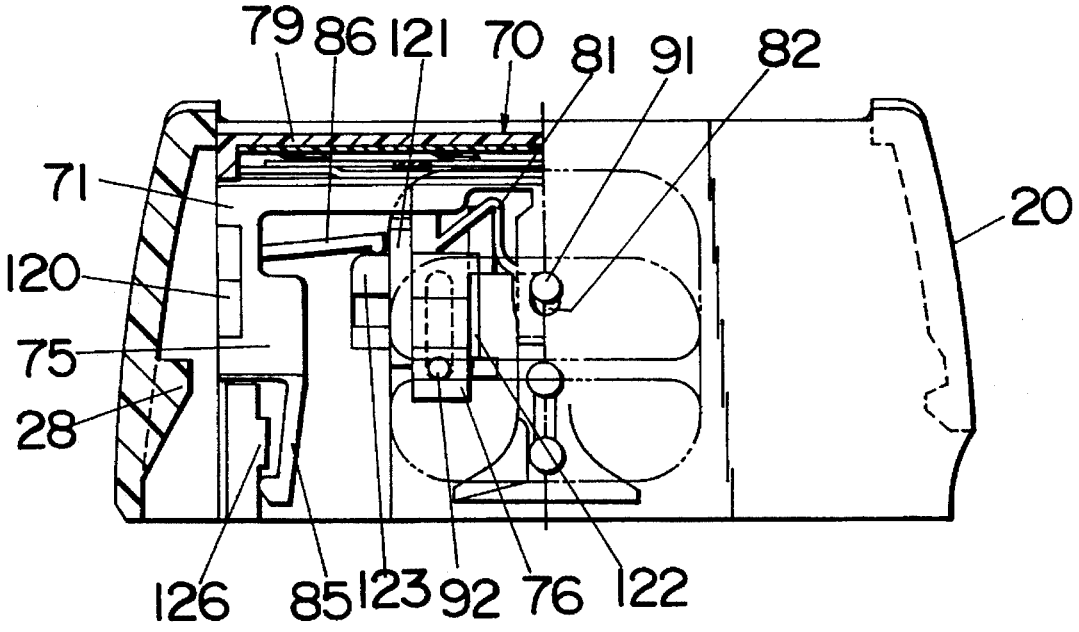
Figure 8:
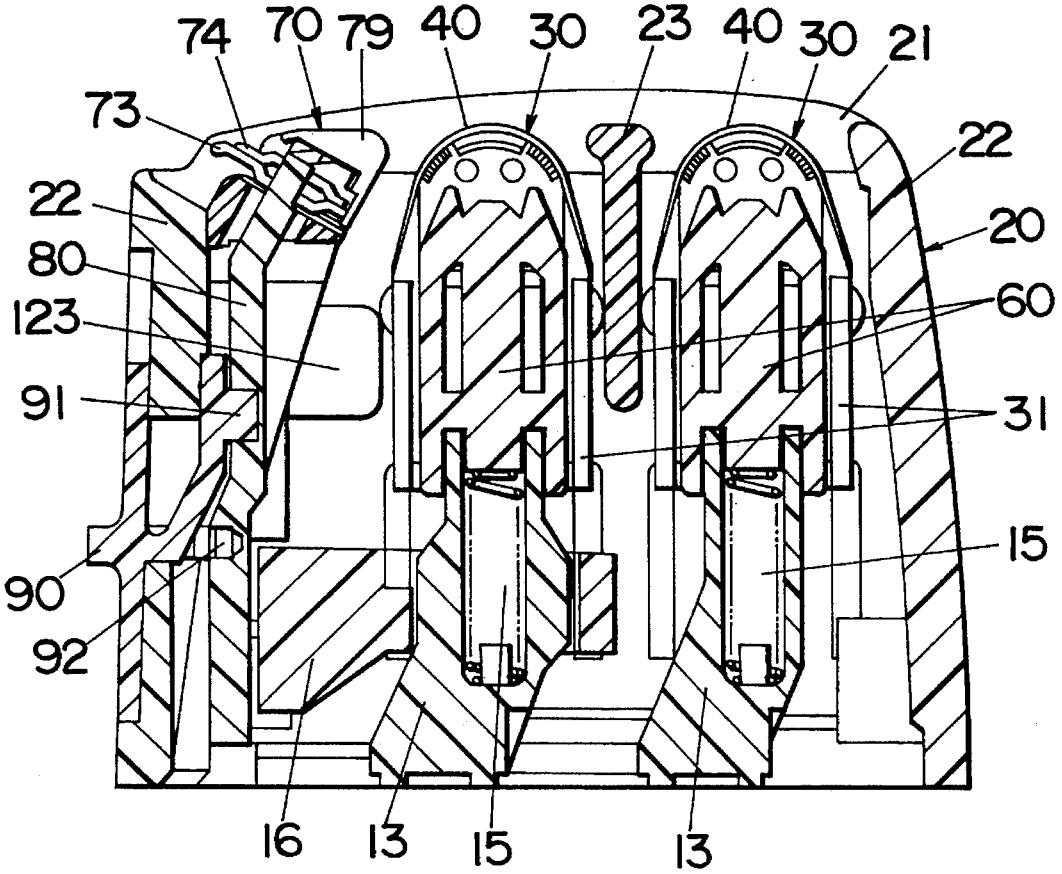
FIG. 8 is a side section illustrating the trimmer in the depressed position.

Turning back to FIG. 6, the holder 71 has a pair of resilient flaps 85 integrally depending from the outer tabs 75 and are each provided with a latch 85A which is engageable with a projection 126 formed on the interior of the head frame 20. When the trimmer 70 is pushed up from the normal position of FIG. 7A to the projected position of FIG. 9, the latch 85A rides over the projection 126 by resiliently deforming the flap 85. The lever 80 is constantly engaged with the drive element 13 so that the movable blade 74 is driven to reciprocate ready for trimming the hairs either in the normal or projected position. The holder 71 is also formed with a pair of resilient arms 86 each extending horizontally inwardly from the upper end of the outer tab 75 and having its free end rested upon the adjacent stud 123 on the interior of the head frame 120, as shown in FIG. 7A. At this normal position, the pivot pin 91 is positioned at the bottom of the elongated hole 82 in the lever 80 to have a vertical clearance $\alpha$ with the upper end of the hole 82, as shown in FIG. 7A. As the slider handle 90 formed with the pivot pin 91 is latched in position relative to the head frame 20, the trimmer 70 is allowed to move downwards by a distance of the clearance $\alpha$ to a depressed position of FIG. 7B (and FIG. 8 where both shaving heads 30 are shown to be also depressed), while resiliently deforming the arms 86. Upon removal of the depressing force, the trimmer 70 returns to the normal position of FIG. 7A by the resiliency of the arms 86. In this sense, the trimmer 70 is also floatingly supported to the head frame 20.

Figure 10:
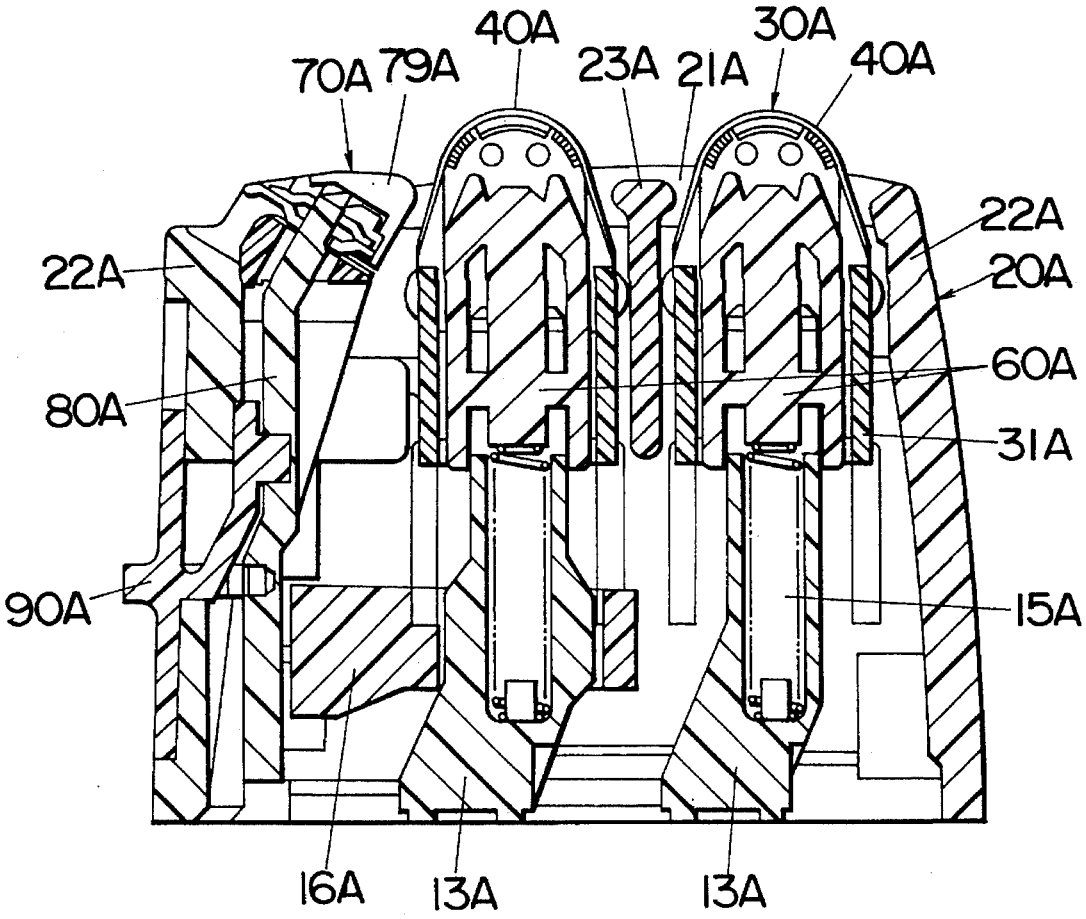
FIGS. 10 and 11 are side sections illustrating individual shaving heads in accordance with modifications of the above embodiment.

It is noted in this connection that, when the trimmer 70 is in the normal position, the top cover 79 of the trimmer 70 has its top surface projected above the adjacent short side wall 22 into the top general plane of the head frame 20, as shown in FIG. 3, so that the top cover 79 can be also responsible for partly bearing the depressing force acting on the adjacent shaving head 30 to displace a portion of that shaving head 30 down beyond the upper end of the head frame 20. When such depressing force is applied to the trimmer 70, the trimmer 70 itself is allowed to be depressed downward to some extent, i.e., by a distance $\alpha$, thus alleviating the depressing force action on the shaving head 30 and therefore protecting the outer shearing foil 40 from deforming excessively. Although the trimmer 70 is shown in this embodiment to be floatingly supported to the head frame 20, the trimmer is not necessarily floatingly supported for the purpose of alleviating the stress applied to the depressed shaving head 30. When floatingly supported, the trimmer 70 is preferred to have a travel distance $\alpha$ which satisfies the relation that $L2+\alpha \leqq L1$. Further, a like floating trimmer 70A may be mounted to the head frame 20A in such a manner as to have its upper end or top cover 79A projecting over the upper end of the head frame 20A in its normal position, as shown in a modification of FIG. 10. In this modification, the trimmer 70A can be itself depressed to the general top plane of the head frame 20A along with the adjacent shaving head 30A for alleviating the depressive force applied to the shaving head 30A, after which it is held stationary and remains bearing the depressive force partly.

Figure 11:
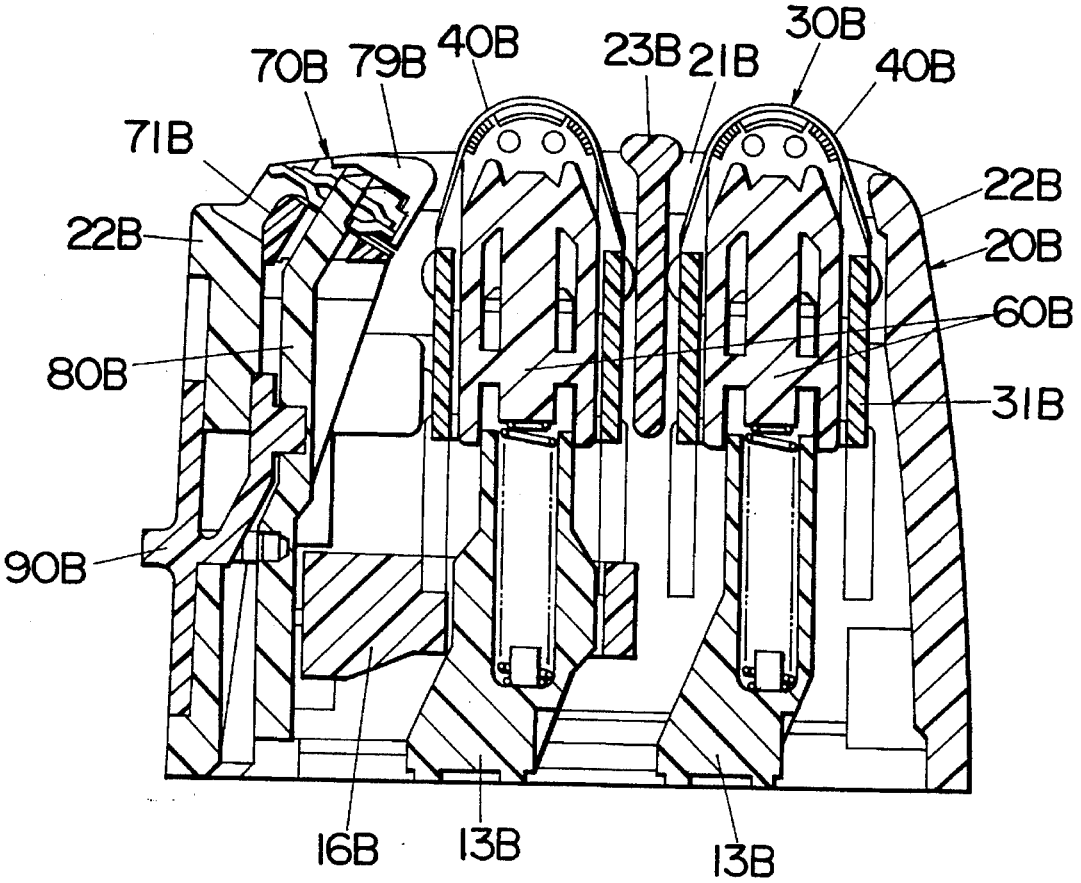

FIG. 11 shows another modification of the above embodiment in which a like separator rib 23B projects beyond the top general plane of a head frame 20B to define itself as a primary stopper for partly bearing the depressive force applied to the shaving head 30B. In this modification, the upper end of the head frame 20B as well as the upper end of the trimmer 70B are made to act as a secondary stopper for bearing the depressive force as in the above embodiment. In these modifications, like parts are designated by like numerals with suffix letters of "A" and "B", respectively, for easy reference. In the modification of FIG. 11, the trimmer 70B may be floatingly supported as in the above embodiment or held stationary relative to the head frame 20B.

What is claimed is:

1. In a dry shaver comprising:

a housing:

a head frame mounted on said housing and supporting a shaving head including (a) an elongated outer shearing foil in a floating manner, said head frame formed with a stopper defined at the top of the head frame so that said stopper is disposed at a first height, and said head frame surrounding the shearing foil and adapted to come into contact with a user's skin and (b) an inner cutter in longitudinally reciprocating hair shearing engagement with said outer shearing foil;

a drive element connected to reciprocate said inner cutter relative to said outer shearing foil;

said outer shearing foil being supported to said head frame by spring means which urge said inner cutter against the outer shearing foil, bias the outer shearing foil upwardly beyond the stopper and allow said outer shearing foil to be depressed to a second height which is no higher than said first height, so that when said outer shearing foil is depressed at a given portion by contact with the user's skin, an upper end of said depressed portion of said outer shearing foil is displaceable downwardly beyond said stopper such that said stopper comes into contact with the skin for bearing a depressing force acting on said outer shearing foil;

said dry shaver including more than one shaving head which is a combination of said outer shearing foil, said inner cutter and said drive element, said shaving heads being arranged in spaced parallel relation within said head frame, said head frame having a rib extending between the outer shearing foils of the adjacent shaving heads so as to define a part of said stopper.

2. The dry shaver as set forth in claim 1, wherein said head frame has an opening into which said outer shearing foil is received in such a manner as to have its upper portion projecting upwardly of the head frame, said head frame defining said stopper at its upper end surrounding said opening.

3. The dry shaver as set forth in claim 1, wherein said head frame carries a trimmer comprising a pair of toothed blades one of which is driven to reciprocate in hair cutting engagement with the other blade in a horizontal direction generally perpendicular to the direction along which said outer shearing foil is movable relative to said head frame, said toothed blades being carried on a trimmer holder of which portion projects upwardly on the upper end of said head frame to define a part of said stopper.

4. The dry shaver as set forth in claim 3, wherein said trimmer is movable between a lower normal position and an upper projected position, said portion of said trimmer holder projects on the upper end of said head frame when said trimmer is in said normal position.

5. The dry shaver as set forth in claim 4, wherein said trimmer in said normal position is floatingly supported to said head frame.

6. The dry shaver as set forth in claim 1 wherein confronting outer side surfaces of the shaving head and inner side surfaces of the head frame have between them at least one protrusion and at least one groove for slidingly receiving said protrusion to act as a guide for the shaving head when moving inwardly and outwardly in relation to the head frame.

* * * * *